United States Patent [19]

Wyss

[11] Patent Number: 4,635,305

[45] Date of Patent: Jan. 13, 1987

[54] FOLDABLE BED

[76] Inventor: André Wyss, Avenue Neuchâtel 56, 2024 St.-Aubin, Switzerland

[21] Appl. No.: 675,994

[22] Filed: Nov. 29, 1984

[51] Int. Cl.[4] ..... A47C 29/00; A47D 7/02

[52] U.S. Cl. ..... 5/99 R; 5/99 A

[58] Field of Search ..... 5/98 R, 98 B, 99 R, 5/99 A, 99 C; 248/188.9, 345.1, 346.1; 16/42 R, 42 T

[56] References Cited

U.S. PATENT DOCUMENTS

| | | | |
|---|---|---|---|
| 2,716,255 | 8/1955 | Laure | 16/42 R |
| 2,910,803 | 11/1959 | Cloce | 248/345.1 |
| 3,158,876 | 12/1964 | Gottlieb | 5/99 R |
| 3,163,870 | 1/1965 | Scotney, III | 5/99 R |
| 3,309,718 | 3/1967 | Sarasin | 5/99 A |
| 3,474,472 | 10/1969 | Hamilton | 5/99 A |
| 3,789,439 | 2/1974 | Berg et al. | 5/99 C |
| 4,455,697 | 6/1984 | Rovida | 5/99 R |

*Primary Examiner*—Gary L. Smith
*Assistant Examiner*—Michael F. Trettel
*Attorney, Agent, or Firm*—Marks Murase & White

[57] ABSTRACT

The foldable bed has a frame including pairs of upper and lower U-shaped supporting tubes, each pair forming a substantially rectangular structure for fixing a cloth forming the side wall of the bed. The supporting tubes are pivotably connected with and supported by two U-shaped legs. The upper supporting tubes and the legs are interconnected by struts locking the upper supporting tubes in a horizontal position when the bed is in its open state for use. The connection between each strut and the adjacent leg is made by means of a sliding member slidable along a side-piece of the leg. This slidable connection between each strut and the adjacent leg substantially facilitates folding and opening the bed and minimizes the danger of hurting the user or a child in the bed.

7 Claims, 6 Drawing Figures

FOLDABLE BED

BACKGROUND OF THE INVENTION

This invention relates to a foldable bed, particularly to a bed or crib for infants, which may easily be folded to a flat portable state and opened for use. A prior bed of this type designed by me and distributed by the Newborne Company, Worthington, Mass., comprises a supporting frame, a cloth forming side walls suspended on said frame and a stiffening bottom plate supported on said frame, said frame having an uper central joint assembly, a pair of upper U-shaped supporting tubes and a pair of U-shaped legs, having a bottom yoke and two upwardly extending side-pieces, said upper supporting tubes and legs being pivotably assembled by means of said joint assembly, lower supporting tubes bridging said side-pieces at a level suitable for supporting said bottom plate, and a pair of struts at each side of the bed, adjacent ends of each pair of struts being pivotably interconnected, the other end of each strut of each pair being pivotably interconnected with the one of said upper supporting tubes, and each strut being pivotably connected to one side-piece of one of said legs.

The struts are pivotably interconnected with said side-pieces of said legs by means of pivot means such as rivets anchored in bores of the side-pieces and struts respectively and allowing no relative displacement between such elements other than rotation. Under these circumstances each strut had to be divided into two parts interconnected by a joint located between the pivot points at the side-piece of the leg and the upper supporting tube. Although this bed is highly appreciated by customers, it has been found that its strut construction is not entirely satisfactory. Due to the pivot means rigidly connected to the strut and to the legs and upper tubes respectively and due to the additional joint between the strut parts, folding and unfolding of the bed was not very easy. The struts had a tendency to jam such that to much force had to be applied for folding and unfolding, this often resulting in bending and other damaging of the struts or adjacent members. It also happened that unskilled persons did not properly manage to fold or unfold the bed and were even hurt.

BRIEF SUMMARY OF THE INVENTION

This invention aims at avoiding all of the above drawbacks of my prior bed by a simple and inexpensive modification. This is achieved by providing connecting means between each of said side-pieces of the legs and the one of said struts, comprising a sliding member on said side-piece and a pivot connection between this sliding member and the adjacent strut, and said struts being undivided, straight members. In this way the foldable struts in two parts interconnected by a separate joint with their tendency to jamming may be replaced by simple straight undivided struts. Due to the slidable connection between struts and side-pieces of the legs, folding and unfolding of the bed is very much facilitated such that handling of the bed does not require any particular force or skill. Damage to the frame of the bed or even injury to of the user is practically impossible.

This invention will now be explained in detail with reference to the drawings showing a preferred embodiment of the foldable bed.

DESCRIPTION OF THE PREFERRED EMBODIMENT

Figure 1:
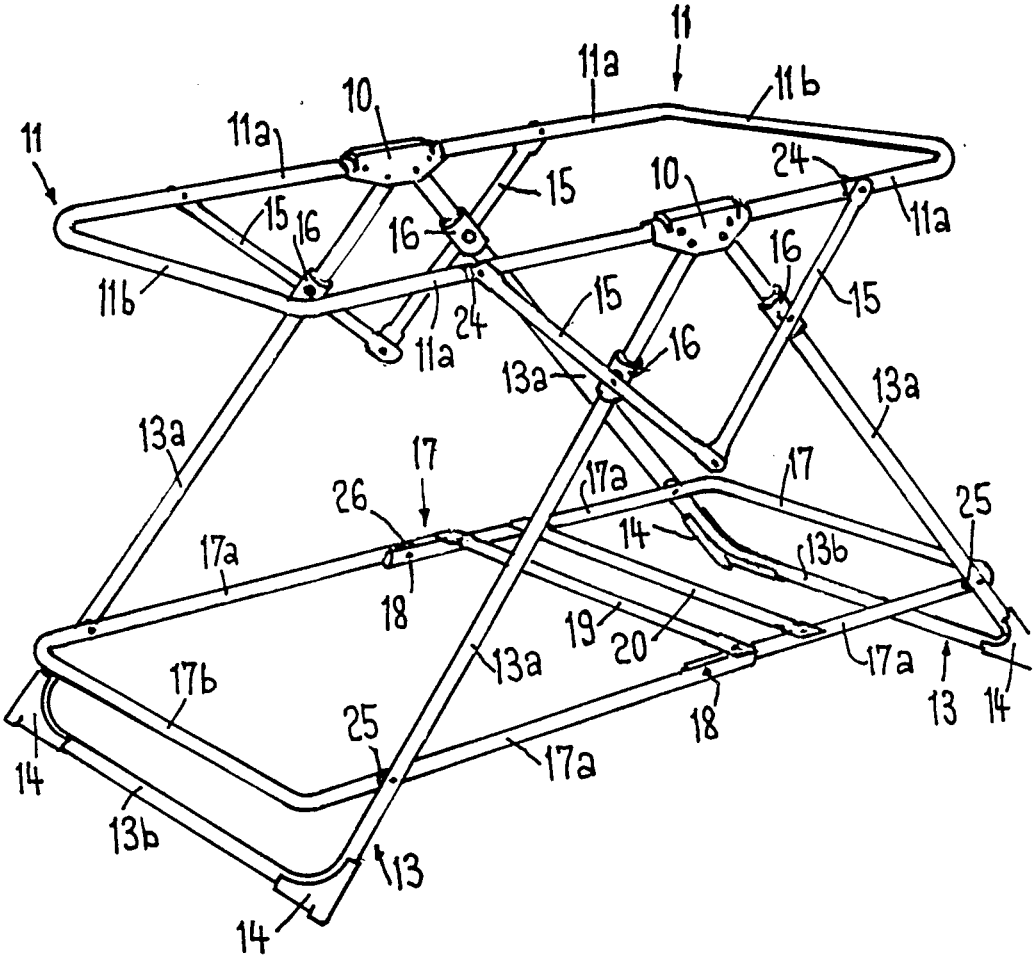
FIG. 1 is a perspective view of the frame of the bed.
Figure 2:
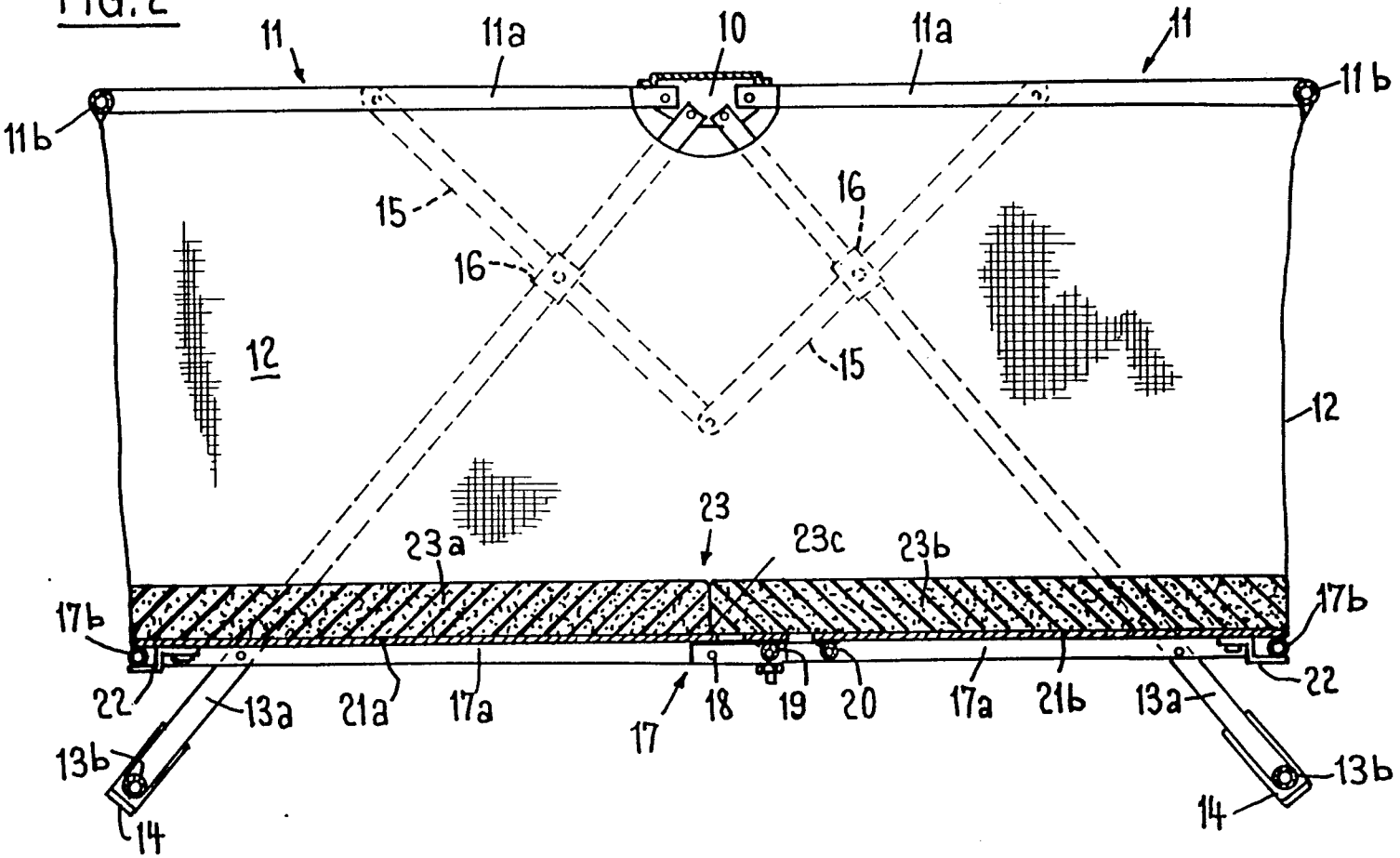
FIG. 2 is a longitudinal section of the bed.
Figure 3:
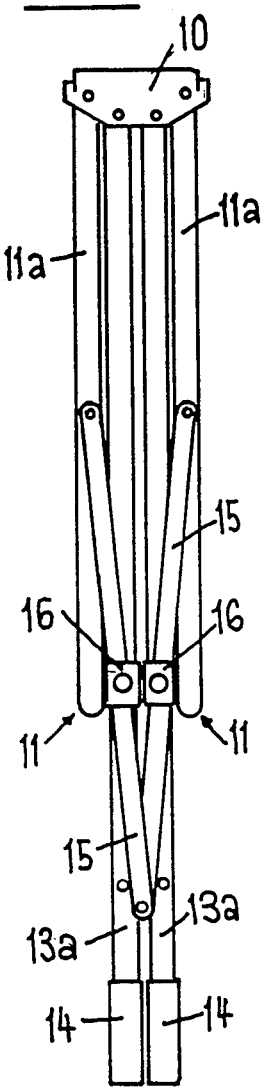
FIG. 3 is a side view of the bed in its folded state.

The bed has a frame best seen in FIG. 1 with two upper central joints 10 wherein four tubular frame portions are pivotably assembled. The frame has two upper U-shaped supporting tubes 11 having each of two side-pieces 11*a* and a yoke member 11*b*. When the bed is unfolded or open as shown in FIG. 1, the upper supporting tubes 11 are in a horizontal plane. As shown in FIG. 2, these supporting tubes serve for suspension of a cloth or net 12 forming side walls of the bed. The frame further has two U-shaped legs 13 having each two side-pieces 13*a* and a bottom yoke 13*b*. The bends between side-pieces 13*a* and the yokes 13*b* are embedded into foot pieces 14 described in more detail below. The upper free ends of side-pieces 13*a* are pivotably connected to the joints 10. It is seen particularly from FIGS. 2 and 3, that the pivot pins, such as rivets, of the legs 13 are nearer to a vertical plane of symmetry of the joints 10 than the pivot pins of the upper supporting tubes 11, such that the supporting tubes 11 and legs 13 may properly be folded into parallel vertical planes as shown in FIG. 3.

Each of the side-pieces of the upper suspending tubes is pivotably interconnected with the upper end of a straight tubular strut 15. The lower ends of pairs of struts 15 are pivotably interconnected. Each strut is further pivotably connected with a tubular slider 16 which may longitudinally slide along one of the side-pieces 13*a* of the legs 13. The sliders 16 are made of a suitable plastic material such as nylon.

At a suitable level above the bottom yokes 13*b* of the legs and the side-pieces 13*a* are pivotably interconnected each with a U-shaped lower supporting tube 17 having each two side-pieces 17*a* and a yoke 17*b*. As seen particularly in FIG. 1, the side-pieces of the lower supporting tubes are overlapping and pivotably connected by pins, for instance by rivets 18. A strut portion 19 is fixed to the top side of the inner end of the side-pieces 17*a* of the left-hand lower supporting tube 17, this strut 19 resting on the top side of the right-hand side-pieces 17*a*. In this way strut 19 forms a stop avoiding further downward collapsing of the pivotably interconnected lower supporting tubes, thereby maintaining such tubes in a common horizontal plane as shown in FIG. 1. The side-pieces 17*a* of the right-hand lower supporting tube are also stiffened by a strut 20 interconnecting them. However, the lower supporting tubes 17 may be folded upwardly as described later.

As shown in FIG. 2 only, a bottom plate subdivided in two parts is fixed to the lower supporting tubes 17. The inner rim of each part 21*a* and 21*b* of the bottom plate is riveted to the strut 19 and 20 respectively, while the outer rims of the bottom plate portions are secured on yokes 17*b* by means of Z-shaped elements 22 riveted to the lower side of the plate part 21*a* and 21*b* respectively. This structure substantially facilitates mounting of the bottom plates because they may simply be shifted onto the yokes 17*b* and then riveted to the struts 19 and 20 respectively. As also shown in FIG. 2, a foldable mattress 23 rests on the bottom plate 21, having portions 23*a* and 23*b* interconnected by means of a bag not shown in FIG. 2 such that the portions 23*a* and 23*b* may be folded round the lower corners at 23*c*. In this way the lower supporting tubes 17, the bottom plate 21 and the mattress 23 supported thereon may be folded upwardly from the position shown in FIG. 2 when the bed is folded. As further indicated in FIG. 2 the cloth or net 12 is connected to the lower supporting tubes 17 and forms side walls safely keeping an infant inside the space limited by the bottom plate 21 and mattress 23 respectively and the cloth or net 12.

Figure 4:
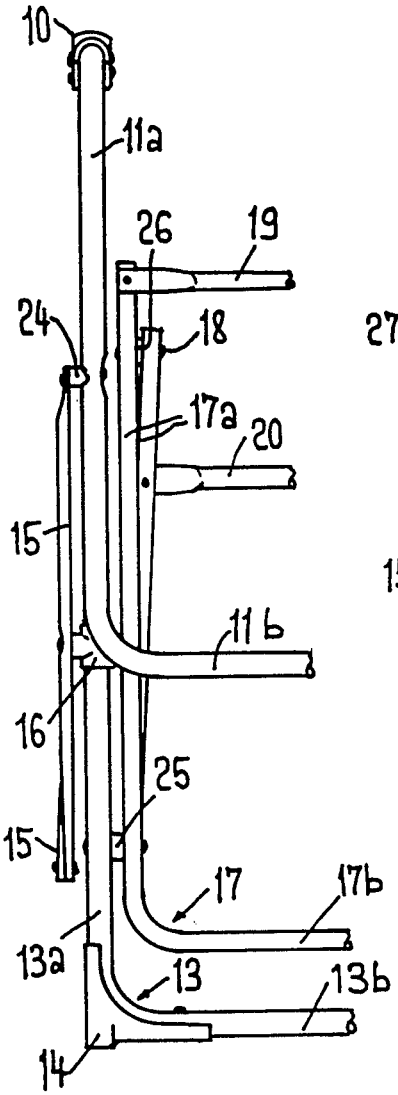
FIG. 4 is a partial front view of the bed in folded state.

As especially illustrated in FIG. 4, the various tubular elements of the frame are laterally spaced from each other in order to allow folding of the frame without mutual obstruction of such elements. The struts 15 are held in an outermost plane on one hand by the sliding members 16 which also have a spacing function, and on the other hand by spacing elements 24 of plastic material. As set out above, the upper supporting tubes 11 and the legs 13 are folded closely together in a common plane. The lower supporting tubes 17 are located in a spaced relationship inside said common central plane by spacing elements 25 of plastic material inserted between the side-pieces 13*a* of the legs and the side-pieces 17*a* and 17*b* respectively of the lower supporting tubes. In this way the elements are spaced from each other as shown and do not obstruct each other when the frame is folded or opened. Further spacing elements 26 are inserted between side-pieces 17*a* and 17*b* at the joint between such pieces in order to allow folding thereof. The spacing elements 24, 25 and 26 serve a double purpose, namely spacing the elements from each other and preventing direct contact and friction between the metallic tubular elements. Of course such spacing elements, made for instance of nylon, also reduce friction and noise when the frame is folded or opened or when a child moves in the bed.

Figure 5:
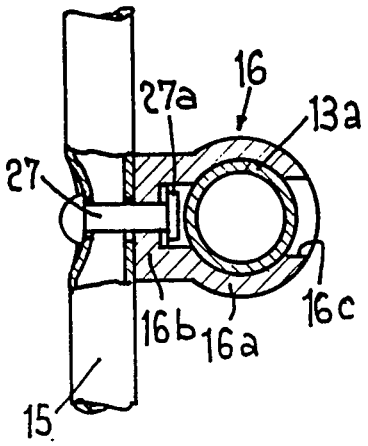
FIG. 5 is a partial section showing a connecting point.
Figure 6:
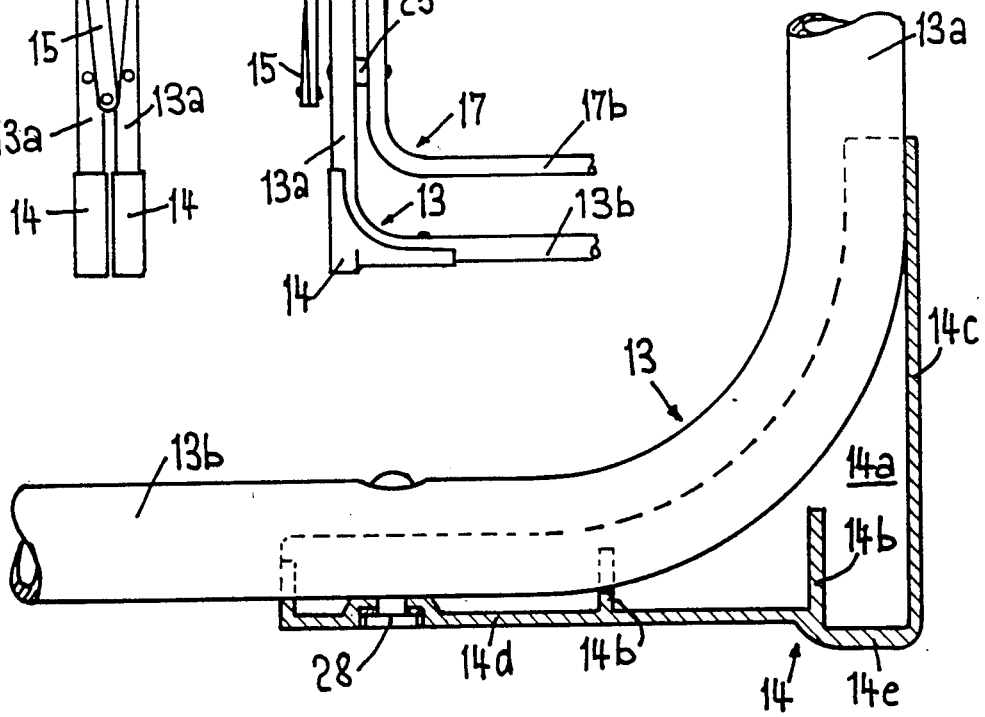
FIG. 6 illustrates details of a foot piece.

FIGS. 5 and 6 illustrate further details of the frame construction. FIG. 5 particularly shows the sliding member 16 with its tubular portion 16*a* and a substantially cylindrical extension 16*b* serving as a spacing element as set out above and a bearing for rivet 27 pivotably interconnecting sliding member 16 with a strut 15. The tubular portion 16*a* has a hole 16*c* opposite the bore of extension 16*b* receiving the rivet. During manufacture, a rivet hammer may be introduced through hole 16*c* for acting onto the inner rivet end for forming a head 27*a* thereon.

FIG. 6 illustrates in detail one of the foot pieces 14 and its position on the leg 13. As shown, the foot piece is an angular upwardly opening element having side walls 14*a* stiffened by ribs 14*b* and outer walls 14*c* and 14*d*. The foot piece 14 is connected to the outer end of the yoke 13*b* by means of one single rivet 28. The corner of the foot piece forms a downwardly extending rest portion 14*e* resting on the ground and supporting the bed. Since the foot piece 14 is fixed at only one point to the yoke 13*b* of the leg 13, and since the ribs 14*b* do not contact the leg, each foot piece is elastically mounted such that its rest portion 14*e* will elastically adapt itself to unevennesses of the ground, this resulting in a high stability of the bed in its opened state during use and in its folded state.

For folding the frame from its open state shown in FIG. 1, it is necessary to first upwardly collapse the lower supporting tubes from their horizontal position. To this end it is sufficient to lift the one side of the lower supporting tubes by a foot inserted therebelow. If the lower supporting tubes are sufficiently collapsed upwardly, the frame may further best be folded by inward pressure onto the legs 13. In an end phase of the folding operation it is sufficient to press inwardly onto the upper supporting tubes. For opening the folded frame or bed, it is sufficient to pull outwardly and upwardly into their horizontal position the upper supporting tubes whereby all the other elements are moved automatically into their opened position. Particularly, the lower supporting tubes automatically assume their lower horizontal position shown in FIG. 1, in which they lock any inward or outward movement of the legs and thus perfectly stabilize the whole frame.

In its folded state the frame together with the mattress may easily be transported and placed for shipping or storage into an cardboard box having for instance a size of 14×57×80 cm.

What is claimed is:

1. A foldable bed having a supporting frame defining two sides, a cloth forming side walls suspended on said frame, and a stiffening bottom plate supported on said frame, said frame having a pair of upper central joint assemblies, a pair of upper U-shaped supporting tubes and a pair of U-shaped legs having a bottom yoke and two upwardly extending side-pieces, said upper supporting tubes and legs being pivotably assembled by means of said joint assemblies, lower supporting tubes bridging said side-pieces at a level suitable for supporting said bottom plate, and a pair of struts at each side of the bed, adjacent ends of each pair of struts being pivotably interconnected, the other end of each strut of each pair being pivotably interconnected with one of said upper supporting tubes, and each strut being pivotably connected to one side-piece of one of said legs, connecting means between each of said side-pieces and a strut, comprising a sliding member on said side-pieces and a pivot connection between said sliding member, and said struts being undivided, straight members, said lower supporting tubes being U-shaped and each having two side-pieces pivotably connected with said side-pieces of one of said legs and a yoke, pairs of side-pieces of said lower supporting tubes overlapping each other on each side of the bed and being pivotably interconnected at the end of one of said side-pieces, a strut bridging the ends of the other side-pieces and resting on said one side-piece when said lower supporting tubes are in their unfolded position thereby locking said lower supporting tubes in a common plane for supporting said bottom plate.

2. A bed according to claim 1, wherein said bottom plate has two separate portions attached each to one of said lower supporting tubes, each portion of said bottom plate having a retaining member gripping below the yoke of the one of said lower supporting tubes, and each portion of said bottom plate being fixed to a strut bridging the side-pieces of the lower supporting tube.

3. A bed according to claim 1, wherein said sliding member has a tubular portion slidable on a side-piece of a leg, an extension from said tubular portion for interconnection with one of said struts and a hole in said tubular portion opposite said extension for insertion of a tool for riveting said strut to said extension.

4. A bed according to claim 1, comprising a foot piece mounted in the bend between the yoke and each of the side-pieces of each leg, said foot piece being of substantially angular shape having portions adjacent the yoke and side-piece of a leg, each foot piece being fixed with one of its portions to the yoke of the leg while the other portion is elastically slidable along the side-piece of the leg, and each foot piece having a rest portion elastically supporting the leg and the bed on the ground.

5. A bed according to claim 1, wherein said cloth is fixed with its rims to said upper and lower supporting tubes respectively, and a foldable mattress being supported on said bottom plate.

6. A bed according to claim 1, wherein said bottom plate is made of two members of different size, the larger of said members covering the lower supporting member including said strut, said larger member overlapping the other of said lower supporting members to which the smaller of said members is connected.

7. A bed according to claim 1, wherein said sliding member serves as a spacing member supporting said struts in planes outside said legs, said struts being also interconnected with said side-pieces of said upper supporting tubes by means of spacing members supporting them in a plane outside said side-pieces of the upper supporting tubes, said side-pieces of said legs and upper supporting tubes being maintained in a central plane, and said side-pieces of the lower supporting tubes being inwardly spaced from said side-pieces of said legs by means of spacing members.

* * * * *